US005251696A

United States Patent [19]

Boone et al.

[11] Patent Number: 5,251,696

[45] Date of Patent: Oct. 12, 1993

[54] METHOD AND APPARATUS FOR VARIABLE SPEED CONTROL OF OIL WELL PUMPING UNITS

[76] Inventors: James R. Boone, 510 B Ave. J. East, Grand Prairie, Tex. 75050; Larry D. Best, Rte. 3, Box 317, Springtown, Tex. 76082; Ronnie D. Brown, 6808 Shadydale, North Richland Hills, Tex. 76180; Hugh A. Brooks, 3410 Faulkner Drive, Rowlett, Tex. 75088

[21] Appl. No.: 863,838

[22] Filed: Apr. 6, 1992

[51] Int. Cl.[5] ..... E21B 43/12; F04B 49/00; F04B 49/06

[52] U.S. Cl. ..... 166/250; 166/53; 166/65.1; 166/68.5; 417/15; 417/223

[58] Field of Search ..... 166/53, 254, 250, 68.5, 166/66.4; 417/1, 15, 53, 223; 73/151, 155

[56] References Cited

U.S. PATENT DOCUMENTS

| | | | |
|---|---|---|---|
| 3,306,210 | 2/1967 | Boyd et al. | 417/1 |
| 3,559,731 | 2/1971 | Stafford | 166/53 |
| 3,568,771 | 3/1971 | Vincent et al. | 166/53 X |
| 4,695,779 | 9/1987 | Yates | 417/1 X |
| 4,925,370 | 5/1990 | Tallarita | 417/15 |

*Primary Examiner*—Stephen J. Novosad
*Attorney, Agent, or Firm*—Andrew J. Dillon

[57] ABSTRACT

A method and apparatus for Varying the speed of operations of an oil well pumping unit powered by a motor wherein variations in oil viscosity may be efficiently accommodated. An oil well pumping unit which includes a submersible pump actuated by means of a reciprocating string of sucker rods is monitored for both rod position and load present on the sucker rods. The oil well pumping unit is driven by an electric or gas motor through a controllable coupling and the speed of the oil well pumping unit is then varied, utilizing the controllable coupling, in response to variations in sucker rod load. As the lowering of the sucker rod is impeded by high viscosity oil, the load on the sucker rod decreases. This decrease in sucker rod load is utilized to decrease the speed of the oil well pumping unit by means of the controllable coupling to ensure that bridle separation does not occur. Additionally, increases in sucker rod load above a preselected maximum may also be detected and utilized to slow the operation of the oil well pumping unit to prevent damage to the sucker rods.

9 Claims, 3 Drawing Sheets

METHOD AND APPARATUS FOR VARIABLE SPEED CONTROL OF OIL WELL PUMPING UNITS

BACKGROUND OF THE INVENTION

1. Technical Field

The present invention relates in general to control systems for use with oil well pumping units and in particular to methods and systems for variable speed control of an oil well pumping unit. Still more particularly the present invention relates to a control system for varying the speed of an oil well pumping unit in response to variations in load within the oil well pumping unit.

2. Description of the Related Art

The recovery of oil from subterranean reservoirs is a well known and long established art. Very few oil well are self flowing and most wells require pumping to lift oil to the surface. This is generally accomplished utilizing a submersible pump within a borehole which is actuated by a reciprocating string of sucker rods extending downward through the borehole to the pump. These sucker rods are generally attached to a polish rod at the surface which passes through a stuffing box and which is generally attached to a mechanical device which produces the necessary reciprocating movement.

Typically, the polish rod is attached to a so-called "walking beam" which is pivotedly mounted to a post. A counter balance weight is generally attached to the other end of the walking beam and the beam is rocked by the action of an electric or gas powered motor, raising and lowing the sucker rods.

In typical operation a pump is operated for some predetermined period of time and then turned off, to permit additional oil to seep into the borehole. If the pump is continually operated the lowing of the level of oil within in the borehole to a point below the pump, a so-called "pump off" condition, can result in excessive wear or even catastrophic failure of the pumping unit, as the pump is forced downward onto the fluid level.

Modern oil well pumping units are often equipped with "pump off" detection devices which monitor the load on the sucker rods and the position of the walking beam to create a graphic representation known as a dynagraph. Automatic or manual examination of this dynagraph may then be utilized to stop the oil well pumping unit for a period of time to permit the borehole to once again fill with oil avoiding the "pump off" condition.

While the aforementioned systems are generally successful they do not address the problems encountered with variable oil viscosity which may exist in certain wells. So-called "heavy" oil is oil of such high viscosity that the oil must often be heated by artificial means in order to permit production by conventional pump units. In such wells after heating by steam injection or other devices, the oil becomes sufficiently thin that normal recovery may take place. Thereafter, as the oil cools, the ability of the pump and sucker rod string to fall through the oil is impeded due to the increased viscosity of the oil as it cools. As a result a condition known as "rod float" may occur. In this condition the bridle which attaches the polish rod to the beam may descend at a faster rate then the rod string, causing a separation between the bridle and the end of the polish rod. Thereafter, as the bridle moves upward while the separated rod string is still falling downward, a tremendous impact may occur, causing failure of the polish rod, the bridle or the sucker rod string Additionally, even if pump unit failure does not occur production is decreased as a result of the failure of the pump unit to complete a full stroke.

It should therefore be apparent that a need exist for a method and system whereby the speed of an oil well pumping unit may be automatically varied to accommodate variations in oil viscosity.

SUMMARY OF THE INVENTION

It is therefore one object of the present invention to provide an improved oil well pumping unit control system.

It is another object of the present invention to provide an improved method and system for variable speed control in an oil well pumping unit.

It is yet another object of the present invention to provide an improved method and system for variable speed control in an oil well pumping unit which responds to variations in a load within the oil well pumping unit.

The foregoing objects are achieved as is now described. An oil well pumping unit which includes a submersible pump actuated by means of a reciprocating string of sucker rods is monitored for both rod position and load present on the sucker rods. The oil well pumping unit is driven by an electric or gas motor through a controllable coupling and the speed of the oil well pumping unit is then varied, utilizing the controllable coupling, in response to variations in sucker rod load. As the lowering of the sucker rod is impeded by high viscosity oil, the load on the sucker rod decreases. This decrease in sucker rod load is utilized to decrease the speed of the oil well pumping unit by means of the controllable coupling to ensure that bridle separation does not occur. Additionally, increases in sucker rod load above a preselected maximum may also be detected and utilized to slow the operation of the oil well pumping unit to prevent damage to the sucker rods.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
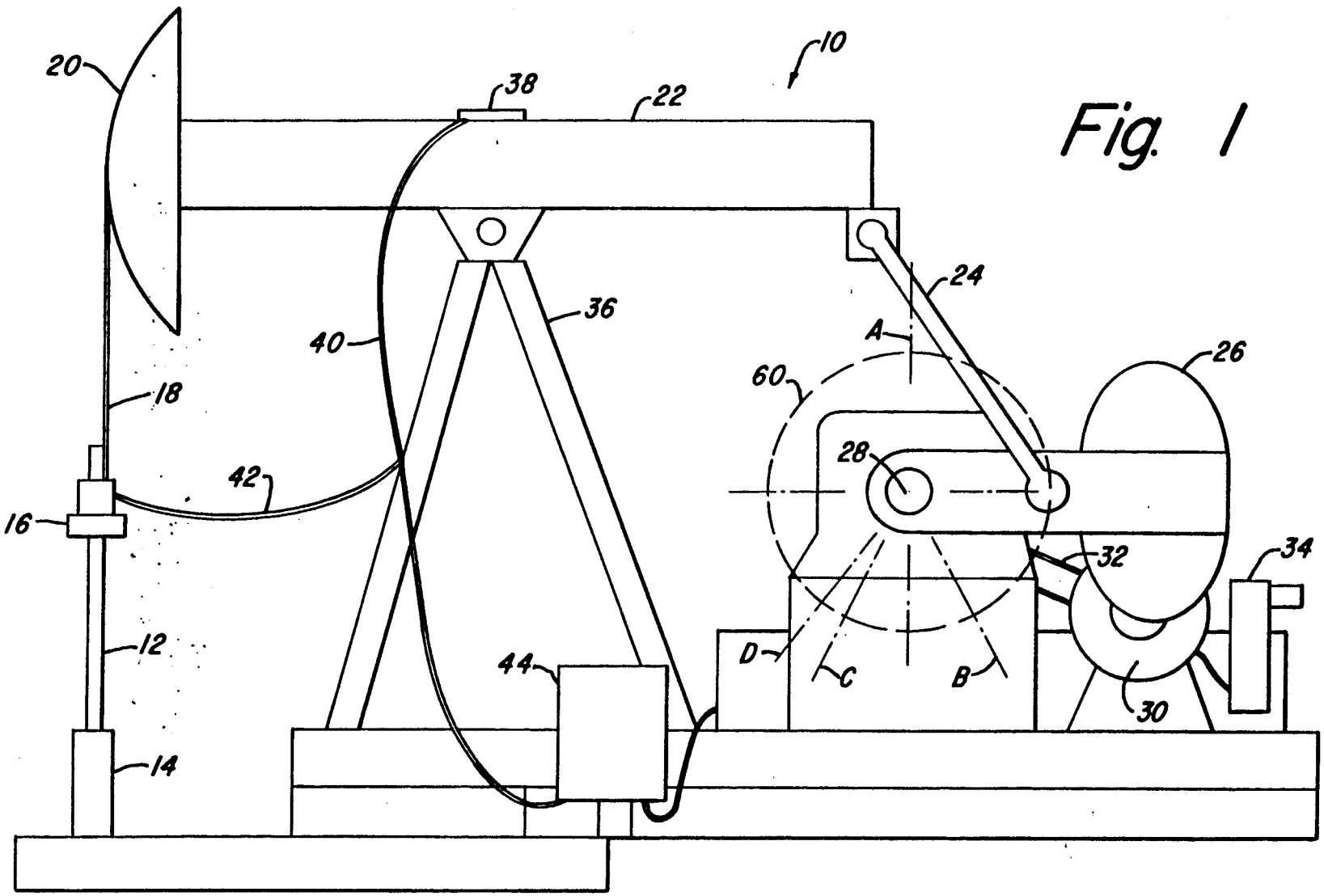
FIG. 1 is a pictorial representation of an oil well pumping unit which includes a variable speed control unit provided in accordance with the method and system of the present invention.

With reference now to the figures and in particular with reference to FIG. 1, there is depicted a pictorial representation of an oil well pumping unit 10, which includes a variable speed control unit provided in accordance with the method and system of the present invention. As illustrated, oil well pumping unit 10 is a conventional oil well pumping unit which includes a polish rod 12, which is preferably attached to a string of sucker rods for reciprocating operation of a submersible pump (not shown). polish rod 12 passes through stuffing box 14 and is attached to the sucker rod string in a manner well known in the art.

As illustrated, the upper end of polish rod 12 is coupled to a bridle 16, which is suspended by cables 18 from horse head 20. Horse head 20 operates in a reciprocating motion as a result of the pivoting of walking beam 22 upon post 36. Walking beam 22 is operated in a reciprocating fashion in a manner well known and conventional in the art by utilizing motor 30 and belt 32 to rotate counterweight 26 about hub 28. Crank rod 24 is utilized to couple the rotating counterweight assembly to the end of walking beam 22 and, as counterweight 26 is rotated utilizing motor 30, walking beam 22 will be rocked upon post 36.

In accordance with an important feature of the present invention, a load cell (not shown) is disposed between a polish rod clamp and bridle 16 and coupled, via cable 42, to controller 44. The load cell is utilized to provide an instantaneous indication of the load present on polish rod 12 during any particular point of operation of oil well pumping unit 10. Also depicted within FIG. 1 is clinometer 38 which is mounted to walking beam 22 and utilized to provide an indication of the angular position of walking beam 22, via cable 40 to controller 44.

In a manner which will be explained in greater detail herein, the position of oil well pumping unit 10 and the load present on polish rod 12 are utilized by controller 44 to generate a control signal which is coupled to drive control 34. In accordance with an important feature of the present invention, this control signal is utilized to vary the speed of operation of oil well pumping unit 10 by varying the coupling between oil well pumping unit 10 and motor 30, in a manner which will be explained in greater detail herein.

Figure 2:
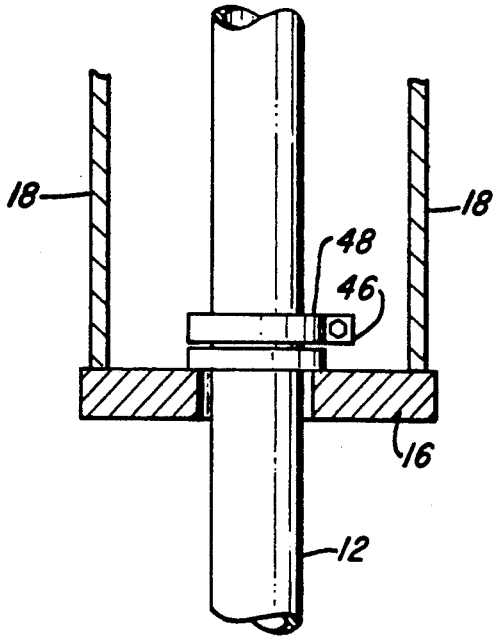
FIG. 2 is a pictorial representation of a load cell mounted between a polish rod and bridle for utilization with the method and system of the present invention.

Referring now to FIG. 2, there is depicted a pictorial representation of a load cell 46 which is mounted between a polish rod clamp 48 and bridle 16. Load cell 46 is utilized to generate an analog indication of the instantaneous load experienced by polish rod 12 at any point during the operation of oil well pumping unit 10. Those skilled in the art will appreciate that load cell 46 may be implemented utilizing any known load cell device, such as, for example, a piezoelectric load cell device.

As described above, a problem exists in high viscosity oil in that during the downstroke the sucker rod string and pump may be impeded by he high viscosity of the oil. In such cases, bridle 16 may be lowered at a speed in excess of the speed at which the rod string can fall through the oil. In such a circumstance, polish rod clamp 48 will separate from bridle 16 and upon reaching the bottom of the pump stroke bridle 16 will be rapidly raised, striking load cell 46 and polish rod clamp 48, possibly causing catastrophic failure of oil well pumping unit 10.

It is therefore one object of the present invention to variably control the speed of oil well pumping unit 10 in a manner such that polish rod clamp 48 is maintained in contact with load cell 46 and bridle 16, by ensuring that a preselected minimum load is present at load cell 46 at all times during operation thereof.

Figure 3:
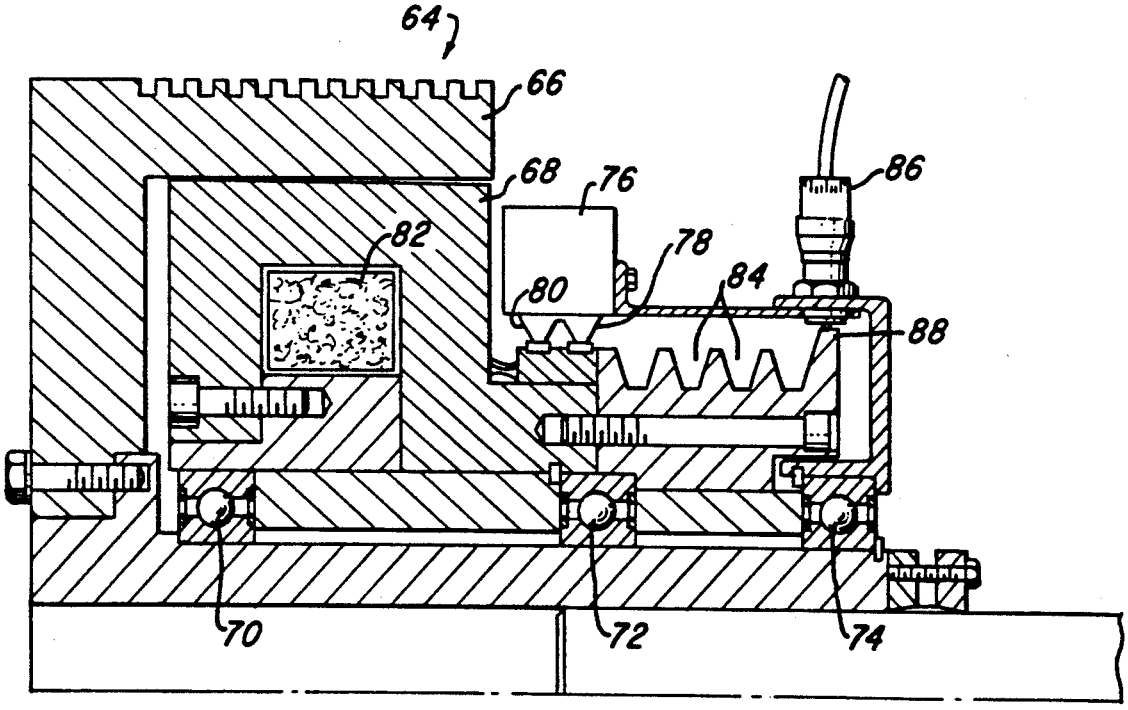
FIG. 3 is a sectional view of one controllable coupling which may be utilized to implement the method and system of the present invention.

The manner in which the speed of oil well pumping unit 10 is controlled to ensure that a minimum load is present at load cell 46 at all times may be illustrated upon reference to FIG. 3, which depicts a sectional view of a controllable coupling 64 which may be utilized to variably couple motor 30 (see FIG. 1) to oil well pumping unit 10. FIG. 3 depicts a well known variable speed drive which includes an armature-fan assembly 66 which is preferably mounted on the shaft of motor 30 and which rotates at the same speed as motor 30. Of course, those skilled in the art Will appreciate that motor 30 may be implemented utilizing an electric motor or a gas motor.

Mounted within armature-fan assembly 66 is V-belt sheave assembly 68. V-belt sheave assembly 68 is preferably rotatably mounted to armature-fan assembly 66 by means of bearings 70, 72, and 74; however, any conventional rotatable mounting system may be utilized. The coupling between V-belt sheave assembly 68 and armature-fan assembly 66 may be variably controlled by applying an electrical signal, via contactor 76 and slip rings 78 and so. When a direct current voltage is applied via slip rings 78 and 80 to control coil 82, armature-fan assembly 66 and V-belt sheave assembly 68 become magnetically coupled, causing V-belt sheave assembly 68 to rotate with motor 30.

As V-belt sheave assembly 68 rotates, sheave 84 also rotates and is preferably utilized to drive multiple V-belts or other suitable drive mechanisms. The speed at which sheave 84 rotates is preferably controllable by detecting the rotation of marker 88 by means of sensor 86 in any manner well known in the art.

For example, sensor 86 may comprise an optical sensor or a Hall-effect sensor which detects a magnet present at marker 88. Thus, by selectively varying the amount of direct current applied via contactor 76 through slip rings 78 and so to control coil 82, the coupling between armature-fan assembly 66 and V-belt sheave assembly 68 may be variably controlled to accurately control the speed at which sheave 84 rotates, effectively controlling the speed of oil well pumping unit 10 by variably controlling the coupling between motor 30 and oil well pumping unit 10 (see FIG. 1). Those skilled in the art will appreciate that controllable coupling 64 may be implemented utilizing conventional available couplings, such as the Magna-Speed Drive, manufactured by Stromag, Incorporated of Dayton, Ohio, or any other suitable controllable coupling.

Figure 4:
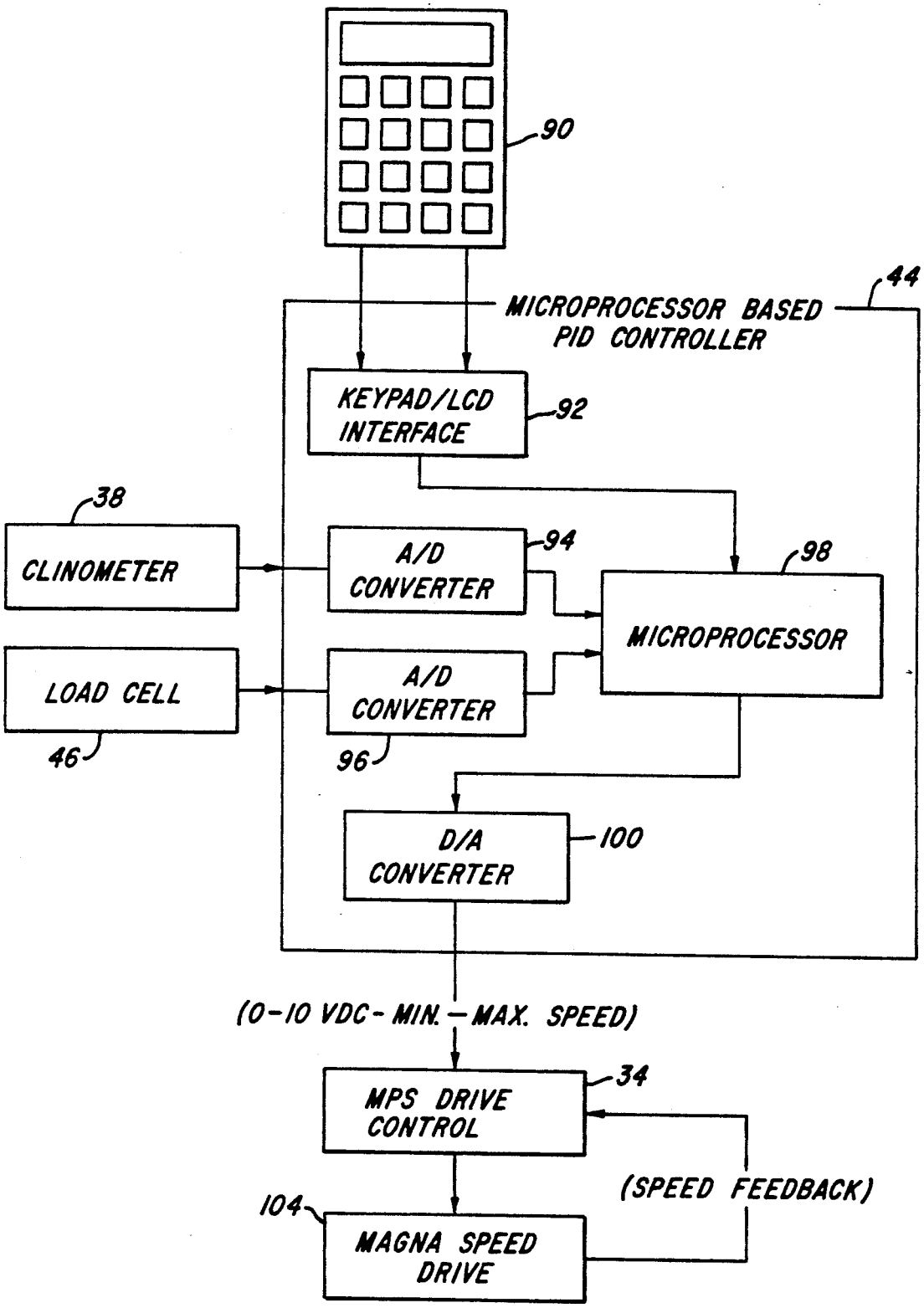
FIG. 4 is a high level block diagram of a control system which may be utilized to implement the method and system of the present invention.

Referring now to FIG. 4, there is depicted a high level block diagram of a control system 44 (see FIG. 1) which may be utilized to implement the method and system of the present invention. As depicted, a keypad/display unit 90 is provided to enable an operator to set certain preselected minimum and maximum load conditions and/or specify other system parameters for the controller. A conventional keypad/LCD interface 92 is preferably utilized to control the scanning of the keys within keypad/display unit 90 and to control the display segments therein by means of microprocessor 98. Additionally, the analog outputs of clinometer 38 and load cell 46 are coupled, via analog-to-digital converters 94 and 96 to microprocessor 98.

Microprocessor 98 is utilized, in a preferred embodiment of the present invention, to continually monitor the position and load within oil well pumping unit 10 such that the operation of oil well pumping unit may be accurately controlled. The depicted embodiment of the present invention utilizes these parameters to control the operation of oil well pumping unit in a well known PID control algorithm. PID controllers will be familiar to those skilled in the art, and are described for example, in *Modern Control Systems*, R. C. Dorf, Addision-Wesley, 5th Edition, 1989, pages 449–453 and 510–511.

PID controllers utilize a control action in which the output of the controller is proportional to a linear combination of the input, the time interval of the input and the time rate-of-change of the input. In a practical embodiment of a proportional plus integral plus derivative control action (PID) the relationship of output and input, neglecting high frequency terms, is:

$$\frac{Y}{X} = \pm P \frac{\frac{I}{s} + 1 + Ds \quad a > 1}{\frac{bI}{s} + 1 + \frac{Ds}{a} \quad 0 \leqq b < 1}$$

where a=derivative action gain
b=proportional gain/static gain
D=derivative action time constant
I=integral action rate
P=proportional gain
s=complex variable
X=input transform
Y=output transform Still referring to FIG. 4, it may be seen that microprocessor based PID controller 44 may be utilized to maintain precise control over the speed of operation of oil well pumping unit 10 by continually monitoring the position of oil well pumping unit 10 and the load present on polish rod 12 utilizing clinometer 38 and load cell 46.

Analog output signals representative of the position of oil well pumping unit 10 and the load present on polish rod 12 are coupled from clinometer 38 and load cell 46 through analog-to-digital converters 94 and 96 to microprocessor 98. The output of the PID controller thus implemented is the coupled to digital-to-analog converter 100 to generate a direct current voltage which varies between zero and ten volts. This control signal will vary the operation of oil well pumping unit 10 from a minimum to a maximum speed. This variable direct current voltage is coupled to drive control circuit 34 which, in the manner described with respect to FIG. 3, may be utilized to Vary the coupling between armature-fan assembly 66 and V-belt sheave assembly 68 (see FIG. 3), in order to accurately control the speed of operation of oil well pumping unit 10. This control signal is coupled to controllable coupling 64 in the manner described above.

Next, the operation of the method and system of the present invention will be described with reference once again to FIG. 1. As oil well pumping unit 10 is started, the speed of operation is set to a preselected minimum speed of operation to ensure that no separation between polish rod clamp 48 (see FIG. 2) and bridle 16 will occur on the first stroke. Controller 44 then preferably increases the speed at which oil well pumping unit 10 operates with each stroke until such time that a subsequent increase in speed would result in a decrease in the load experienced at load cell 46 to a point below the predetermined minimum load entered by the operator at keypad/display unit 90. In the event the load experienced at load cell 46 decreases below the preset minimum, it is clear that separation of polish rod clamp 48 and bridle 16 has occurred and the speed of oil well pumping unit 10 will be decreased. Should oil well pumping unit 10 be shut down for any reason, the start cycle described above will be repeated.

In operation, when the rotation of counterweight 26 reaches point A on the arc of rotation described at reference numeral 60, the bottom of the polish rod stroke has occurred. At this point the load on polish rod 12 must be equal to some predetermined minimum load, such as fifty pounds, before controller 44 will increase the speed of oil well pumping unit 10 to begin the upstroke to maximum speed. This procedure ensures that no separation of bridle 16 and polish rod clamp 48 will exist when pump speed is increased. Of course, those skilled in the art will appreciate that the preselected minimum loads, set points and speed rates are all adjustable.

The speed of oil well pumping unit 10 during the upstroke is controlled such that maximum speed is attained without overloading the pumping unit components. That is, a predetermined maximum load may be specified for load cell 46 and the speed of operation of oil well pumping unit 10 may be decreased as necessary to ensure that this maximum load is not exceeded. If the maximum speed experienced during the upstroke of polish rod 12 by oil well pumping unit 10 falls below some predetermined minimum, the controller may be utilized to stop the operation of oil well pumping unit 10 for some preselected period of time and restart oil well pumping unit 10. Thereafter, in the event an overload condition still exists, the control unit will preferably shut down oil well pumping unit 10 until such time as the unit may be restarted manually.

Still referring to the set points depicted within FIG. 1, when set point B within arc of rotation 60 is reached, deceleration from the maximum speed on the upstroke is initiated down to a minimum speed necessary to prevent separation of polish rod clamp 48 and bridle 16, in accordance with the experience of the control system from the prior stroke. This deceleration is governed by sensing the output of load cell 46 at set point C. In the event the output of load cell 46 reaches zero at set point C, separation 14 between polish rod clamp 48 and bridle 16 has occurred at the top of the stroke due to the fact that deceleration occurred at too slow a rate and at the next stroke of oil well pumping unit 10, the deceleration will occur at a more rapid rate. If the output of load cell 46 at set point c is greater than a preselected amount, the deceleration rate will, of course, be lowered.

Thereafter, from set point D until set point A is once again reached, the microprocessor based PID controller 44 will allow the polish rod to fall as rapidly as permitted by the viscosity of the oil within the borehole, without allowing separation between polish rod clamp 48 and bridle 16 to occur, by maintaining the speed of oil well pumping unit 10 at that rate necessary to maintain a specified minimum load, as experienced at load cell 46. This, as those skilled in the art will appreciate, may be done simply by monitoring the output of load cell 46 and varying the coupling between motor 30 and oil well pumping unit 10 to maintain the specified conditions.

Upon reference to the foregoing, those skilled in the art will appreciate that the Applicants herein have provided a novel, useful and unobvious method whereby the speed of operation of an oil well pumping unit may be varied during operation thereof to accommodate variations in the viscosity of oil, thereby maximizing the efficiency of an oil well pumping unit in wells in which the viscosity of the oil may vary during operation thereof.

While the invention has been particularly shown and described with reference to a preferred embodiment, it will be understood by those skilled in the art that various changes in form and detail may be made therein without departing from the spirit and scope of the invention.

We claim:

1. A method of variable speed control of the operation of an oil well pumping unit wherein variations in oil viscosity may be efficiently accommodated, said method comprising the steps of:

detecting variations in position of said oil well pumping unit during operation thereof;

detecting load variations within said oil well pumping unit at selected positions during operation thereof; and variably adjusting the speed of operation of said oil well pumping unit in response to said load variations within said oil well pumping unit wherein variations in oil viscosity may be efficiently accommodated.

2. The method of variable speed control of the operation of an oil well pumping unit according to claim 1 wherein said oil well pumping unit is powered by an electric motor and wherein said step of variably adjusting the speed of operation of said oil well pumping unit comprises the step of varying a coupling between said electric motor and said oil well pumping unit.

3. A variable speed control for controlling the operation of an oil well pumping unit powered by a motor, said variable speed control comprising:

position detection means for detecting variations in position of said oil well pumping unit during operation thereof;

load detection means for detecting variations in load which occur within said oil well pumping unit;

variable coupling means for variably coupling said oil pumping well unit to said motor; and control means coupled to said load detection means, said position detection means and said variable coupling means for selectively varying said coupling between said oil well pumping unit and said motor in response to variations in load which occur within said oil well pumping unit at selected positions during operation thereof.

4. The variable speed control for controlling the operation of an oil well pumping unit powered by a motor, according to claim 3, wherein said oil well pumping unit comprises a submersible pump activated by means of a string of sucker rods and wherein said load detection means comprises means for detecting strain on said string of sucker rods.

5. A variable speed control for controlling the operation of an oil well pumping unit powered by a motor, according to claim 3, wherein said variable coupling means comprises an electrically controllable clutch assembly for variably coupling said oil well pumping unit to said motor.

6. A variable speed control for controlling the operation of an oil well pumping unit powered by a motor, according to claim 3, wherein said control means comprises a microprocessor based PID controller.

7. A variable speed control for controlling the operation of an oil well pumping unit powered by a motor, said variable speed control comprising:

load detection means for detecting variations in load which occur within said oil well pumping unit;

an electrically controllable clutch assembly for variably coupling said oil well pumping unit to said motor; and control means coupled to said load detection means and said electrically controllable clutch assembly for selectively varying said coupling between said oil well pumping unit and said motor in response to variations in load which occur within said oil well pumping unit.

8. A variable speed control for controlling the operation of an oil well pumping unit powered by a motor, according to claim 7, wherein said oil well pumping unit comprises a submersible pump activated by means of a string of sucker rods and wherein said load detection means comprises means for detecting strain on said string of sucker rods.

9. The variable speed control for controlling the operation of an oil well pumping unit powered by a motor, according to claim 7, wherein said control means comprises a microprocessor based PID controller.

* * * * *